US010898007B1

(12) United States Patent
Rozon

(10) Patent No.: US 10,898,007 B1
(45) Date of Patent: Jan. 26, 2021

(54) PREGNANCY SUPPORT CUSHION

(71) Applicant: Leanne C. Rozon, Eltham (AU)

(72) Inventor: Leanne C. Rozon, Eltham (AU)

( * ) Notice: Subject to any disclaimer, the term of this patent is extended or adjusted under 35 U.S.C. 154(b) by 276 days.

(21) Appl. No.: 16/115,362

(22) Filed: Aug. 28, 2018

(51) Int. Cl.

| | |
|---|---|
| ***A47C 20/02*** | (2006.01) |
| ***A47C 20/00*** | (2006.01) |
| ***A47G 9/02*** | (2006.01) |
| ***A47G 9/10*** | (2006.01) |

(52) U.S. Cl.
CPC ..... *A47C 20/025* (2013.01); *A47C 20/021* (2013.01); *A47C 20/027* (2013.01); *A47G 9/0253* (2013.01); *A47G 9/10* (2013.01); *A47G 2009/1018* (2013.01)

(58) Field of Classification Search
CPC ... A47C 20/025; A47C 20/021; A47C 20/027; A47G 9/0253; A47G 9/10; A47G 2009/1018
USPC ..... 5/636; D6/601
See application file for complete search history.

(56) References Cited

U.S. PATENT DOCUMENTS

| | | | | | |
|---|---|---|---|---|---|
| 267,299 | A | | 11/1882 | Willson | |
| 546,107 | A | | 9/1895 | Warner | |
| 2,720,660 | A | * | 10/1955 | Smith | A47G 9/10 5/636 |
| 4,228,879 | A | | 10/1980 | Woodbury | |
| 4,802,249 | A | * | 2/1989 | Bills | A47C 20/021 5/420 |
| 5,815,863 | A | * | 10/1998 | Dolisi | A47C 20/021 5/632 |
| 6,047,419 | A | * | 4/2000 | Ferguson | A47C 20/025 5/630 |
| 6,154,904 | A | * | 12/2000 | Ehredt | A45C 3/10 5/639 |
| 6,751,817 | B1 | * | 6/2004 | Leach | A47C 20/021 5/630 |
| 7,017,213 | B2 | * | 3/2006 | Chisari | A47C 20/026 5/630 |
| 7,055,196 | B2 | | 6/2006 | Littlehorn | |
| 7,353,551 | B2 | | 4/2008 | Covolis | |
| 7,793,371 | B1 | | 9/2010 | Leach | |
| 7,810,191 | B2 | | 10/2010 | Littlehorn | |

(Continued)

FOREIGN PATENT DOCUMENTS

| | | |
|---|---|---|
| WO | WO 2011/052908 | 10/2010 |

*Primary Examiner* — Peter M. Cuomo
*Assistant Examiner* — Myles A Throop
(74) *Attorney, Agent, or Firm* — Eric Karich; Karich & Associates

(57) ABSTRACT

A support cushion has a wedge-shaped body for supporting a woman's abdomen and an elongate pillow body receivable between the woman's legs for supporting the woman's knees, pelvic joints, and lower back while she is lying on her side. A fabric covering defining first and second compartments, respectively shaped and sized for receiving the wedge-shape body and elongate pillow body therein, and configured relative to one another thereby to orientate one end of the elongate pillow body end-to-end with one of the side ends of the wedge-shaped body such that the elongate pillow body extends laterally outwardly from the wedge-shaped body. The lower surface of the wedge-shaped body and the lower surface of the elongate pillow body are substantially co-planar, with the rear surface of the wedge-shaped body being the rearmost surface of the support cushion.

12 Claims, 4 Drawing Sheets

(56) References Cited

U.S. PATENT DOCUMENTS

| | | | | |
|---|---|---|---|---|
| 8,136,186 | B1 | 3/2012 | Leach | |
| 8,468,627 | B2 | 6/2013 | Leach | |
| 8,646,134 | B1 * | 2/2014 | Alletto, Jr. | A47G 9/1036 5/636 |
| 8,661,586 | B2 * | 3/2014 | Melcher | A47C 20/027 5/630 |
| 2005/0005358 | A1 * | 1/2005 | DuDonis | A61G 7/065 5/632 |
| 2007/0044233 | A1 * | 3/2007 | Al-Sabah | A47C 17/045 5/7 |
| 2008/0052832 | A1 * | 3/2008 | Racovolis | A47C 20/025 5/632 |
| 2008/0120786 | A1 * | 5/2008 | Furlow | A47C 7/425 5/722 |
| 2009/0038078 | A1 * | 2/2009 | House | A47C 20/023 5/636 |
| 2012/0084923 | A1 * | 4/2012 | Sveinsdottir | A47G 9/10 5/640 |
| 2015/0208812 | A1 * | 7/2015 | Fenton | A47G 9/10 5/632 |
| 2017/0332812 | A1 * | 11/2017 | Colton | A47G 9/10 |
| 2019/0069686 | A1 * | 3/2019 | Miller | A47C 20/023 |
| 2019/0133349 | A1 * | 5/2019 | Fux | A47G 9/10 |

* cited by examiner

PREGNANCY SUPPORT CUSHION

BACKGROUND OF THE INVENTION

Field of the Invention

This invention relates generally to support cushions, and particularly a support cushion for use by pregnant women. The support cushion includes a wedge-shaped body portion and an elongate pillow body portion. In use, and with the user lying on the user's side, the wedge-shaped body is adapted to support the abdomen of the user, with the elongate pillow body receivable between the user's legs thereby to support the knees, pelvic joints, and lower back, and comfort the user.

Description of Related Art

The prior art teaches of many variations of support cushions, or what are also commonly referred to as pregnancy pillows.

Racovolis, U.S. Pat. No. 7,353,551, teaches a support cushion that includes a recess for supporting the 20 abdomen of a pregnant woman. A lower portion of the cushion may be positioned between the user's legs.

Pate, U.S. Pat. No. 4,288,879, teaches a wedge-type pillow for support of the expanded abdomen of a pregnant woman during the latter stages of pregnancy. The pillow is wedge-shaped and has an appropriately shaped cavity in its upper surface for receiving and supporting the expanded abdomen of a pregnant woman lying on her side. The pillow is manufactured from foam rubber or another suitable resilient material. The combination of the resilient nature of the pillow and its geometrical configuration comfortably supports the expanded abdomen.

Leach, U.S. Pat. No. 8,136,186, teaches a multi-purpose pillow assembly that includes a long C-shaped pillow and a short abdomen-supporting pillow adjacent the long pillow, with an underbody pad extending between them. A sleeve surrounds the long pillow and is attached to the side of the underbody pad opposite the short pillow. The sleeve can be rotated around the circumference of the long pillow and moved along its length, providing an assortment of possible configurations. Rotating the sleeve adjusts the distance between the long and short pillows for accommodating the girth of the user. The short pillow can be positioned on either side of the long pillow or on top of it. In another embodiment, the pillow assembly comprises a short pillow with an attached under body panel. In addition to its use as a support pillow for a user in a reclining position, this pillow assembly may serve as a back support pillow in a chair or other seat.

Littlehorn, U.S. Pat. No. 7,055,196, teaches a pillow which comprises a curved pillow body having a top region and a bottom region. The top region is larger in size than the bottom region. Also, the bottom region is adapted to be placed between a user's legs while the user is lying on her side while the top region conforms to the user's stomach and chest. Similar pillows are also shown in Littlehorn, U.S. Pat. No. 7,810,191, and Leach, U.S. Pat. No. 7,793,371.

SUMMARY OF THE INVENTION

The present invention teaches certain benefits in construction and use which give rise to the objectives described below.

The present invention provides a support cushion that includes a wedge-shaped body for supporting a woman's abdomen and an elongate pillow body receivable between the woman's legs for supporting the woman's knees, pelvic joints, and lower back while she is lying on her side. A fabric covering defining first and second compartments, respectively shaped and sized for receiving the wedge-shape body and elongate pillow body therein, and configured relative to one another thereby to orientate one end of the elongate pillow body end-to-end with one of the side ends of the wedge-shaped body such that the elongate pillow body extends laterally outwardly from the wedge-shaped body. The lower surface of the wedge-shaped body and the lower surface of the elongate pillow body are substantially coplanar, with the rear surface of the wedge-shaped body being the rearmost surface of the support cushion.

A primary objective of the present invention is to provide a support cushion having advantages not taught by the prior art.

Another objective is to provide a support cushion that includes a wedge-shaped body for supporting a pregnant woman's abdomen, and also an elongate pillow body that extends downwardly for being positioned between the pregnant woman's legs.

A further objective is to provide a support cushion wherein the wedge-shaped body is made from a material being firmer than the material from which elongate pillow body is made, such as a foam material such as a memory foam.

A further objective is to provide a support cushion wherein the elongate pillow body is made from a polyester or cotton material housed in a cover.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a support cushion that is adapted for use by pregnant women. The support cushion includes a wedge-shaped body portion and an elongate pillow body portion, as discussed in greater detail below. In use, and with the user lying on the user's side, the wedge-shaped body is adapted to support the abdomen of the user, with the elongate pillow body receivable between the user's legs thereby to support the knees, pelvic joints, and lower back, and comfort the user.

Figure 1:
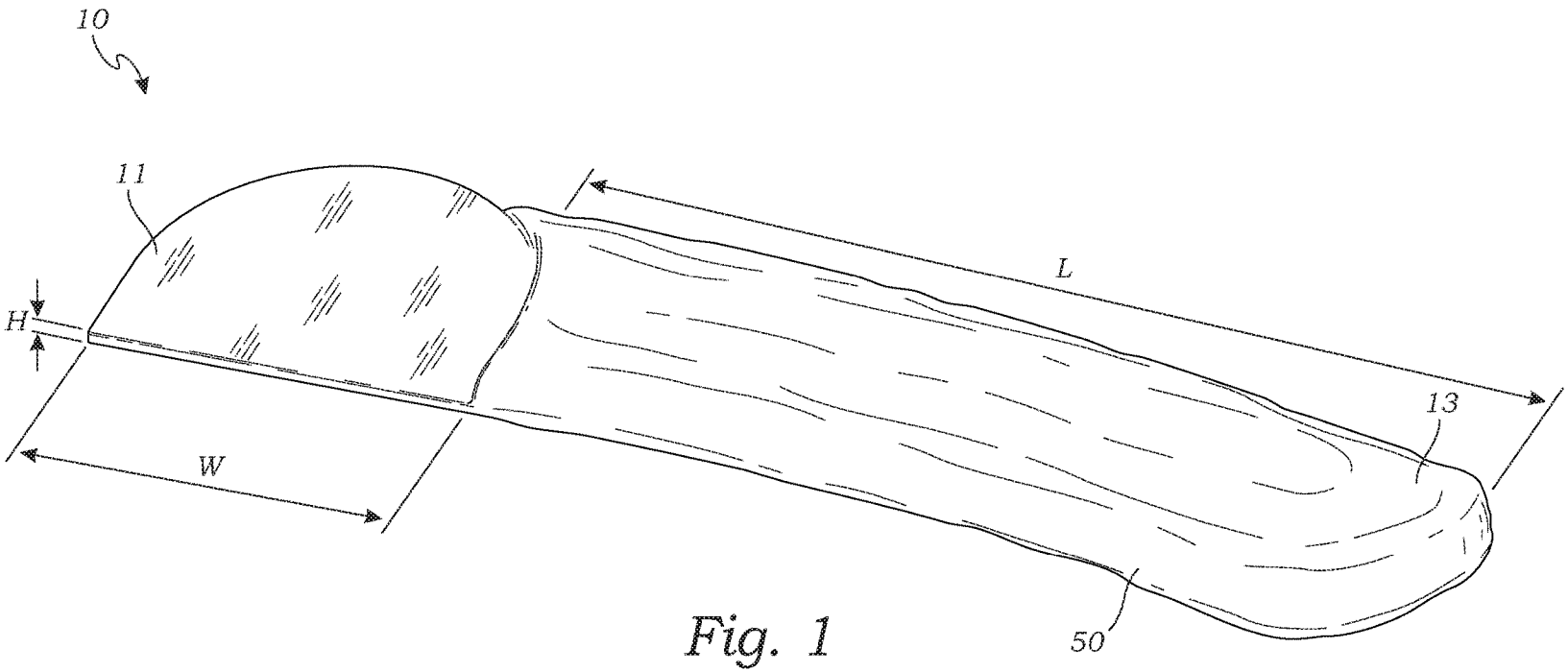
FIG. 1 is a perspective front view of a support cushion according to one embodiment of the present invention, with respective wedge-shaped body and an elongate pillow body portions received within a fabric cover.

FIG. 1 is a perspective front view of a support cushion 10 according to one embodiment of the present invention. In the embodiment of FIG. 1, the support cushion 10 includes a first end 11 that contains a wedge-shaped body 12 (shown in FIG. 3) for supporting a user's abdomen with the user lying on the user's side, and a second end 13 that contains an elongate pillow body 30 (shown in FIG. 3) receivable between the user's legs. The exterior is in the form of a fabric cover 50 that is shaped for retaining the wedge-shaped body 12 and elongate pillow body 30 in an end-to-end orientation relative to one another.

Figure 2:
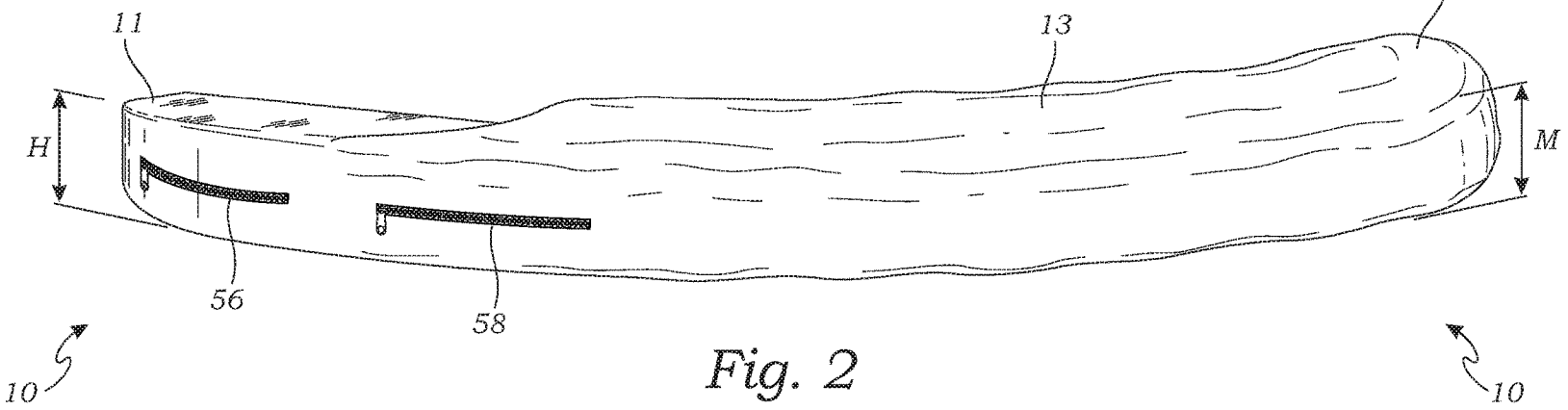
FIG. 2 is a perspective rear view of the support cushion of FIG. 1, showing a pair of closure zippers in the fabric cover for opening and closing access openings through which the respective wedge-shaped body and the elongate pillow body are loadable and unloadable from the fabric cover.

FIG. 2 is a perspective rear view of the support cushion 10, showing a pair of closure zippers 56 and 58 in the fabric cover 50 for opening and closing access openings through which the respective wedge-shaped body and the elongate pillow body are loadable and unloadable from the fabric cover. These features are discussed in greater detail below.

Figure 3:
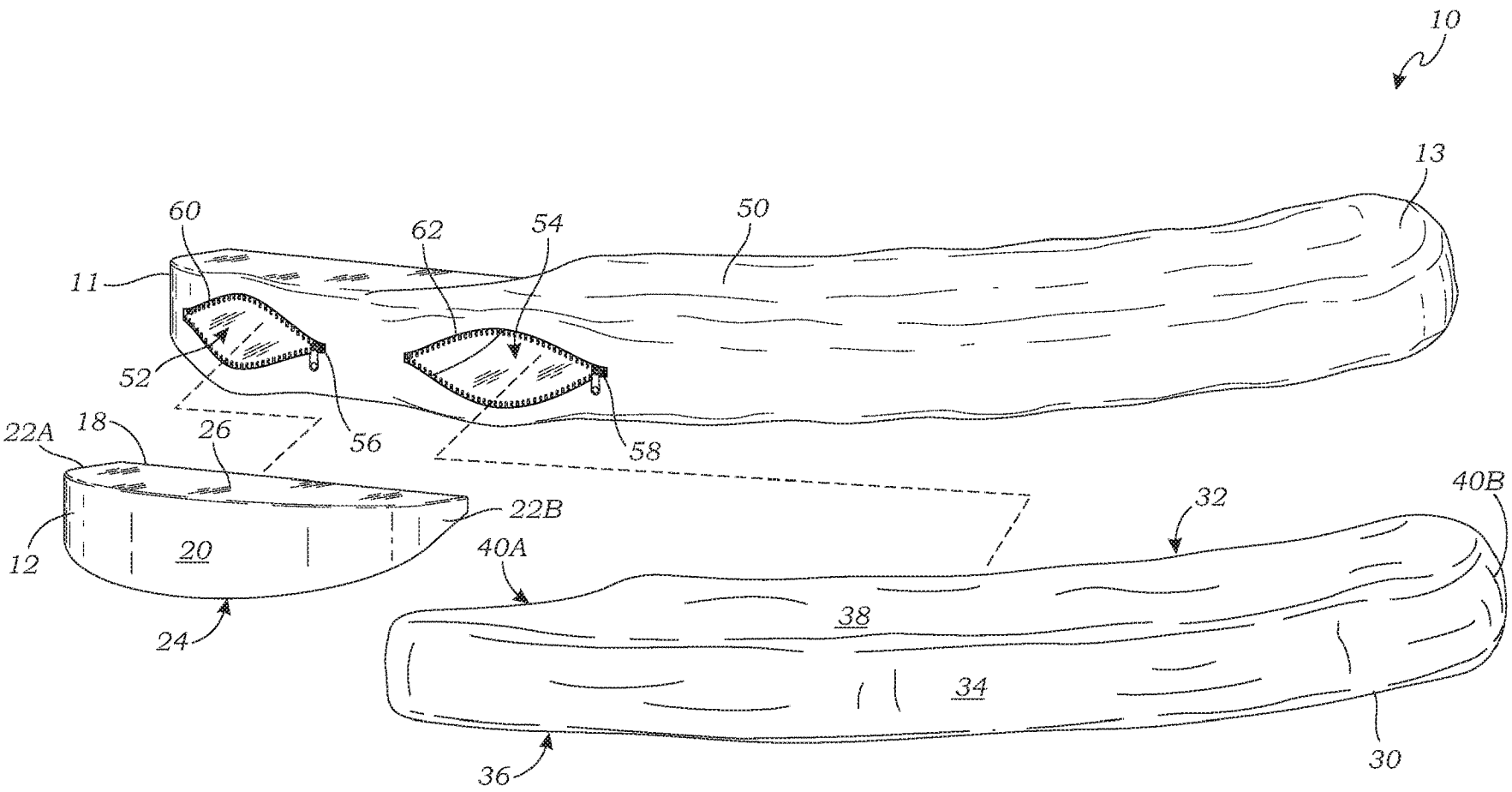
FIG. 3 is a perspective rear view of the support cushion of FIG. 1, with the closure zippers opened, thereby opening the access openings and providing access to the interior of the fabric cover.

FIG. 3 is a perspective rear view of the support cushion 10, with the closure zippers 56 and 58 opened, thereby opening the access openings and providing access to the interior of the fabric cover 50. As shown in FIG. 3, the wedge-shaped body 12 has a front surface 18, a rear surface 20, a pair of side ends 22A, 22B, a lower surface 24 and an upper surface 26 tapering downwardly from the rear surface 20 towards the front surface 18. The rear surface 20 of the wedge-shaped body 12 has a height dimension greater than a height dimension of the front surface 18.

The elongate pillow body 30 has a front surface 32, a rear surface 34, a lower surface 36, an upper surface 38 and a pair of opposing ends 40A, 40B. It will be appreciated that the front surface 32 and the rear surface 34 of the elongate pillow body 30 have similar height dimensions such that the elongate pillow body 30 is substantially rectangular or tubular in shape.

The fabric cover 50 defines a first compartment 52 and a second compartment 54 respectively shaped and sized for receiving the wedge-shape body 12 and elongate pillow body 30 therein. Furthermore, the first compartment 52 and second compartment 54 are configured relative to one another thereby to orientate and retain one end 40A of the elongate pillow body 30 end-to-end with one of the side ends 22B of the wedge-shaped body 12 such that the elongate pillow body 30 extends laterally outwardly from the wedge-shaped body 12 as illustrated in FIG. 1.

With reference to FIG. 2 and FIG. 3, each of compartments 52, 54 of the fabric cover 50 includes a respective closure, preferably in the form of first and second zippers 56, 58, for opening and closing access openings 60, 62 through which the respective wedge-shaped body 12 and elongate pillow body 30 are loadable and unloadable from the fabric cover 50. To ensure maximum comfort to the user, the first and second zippers 56, 58 are located on the fabric cover 50 such that they lie against the rear surfaces 20, 34 of the respective wedge-shaped body 12 and elongate pillow body 30.

To further ensure comfort, the elongate pillow body 30 is a cotton cover stuffed with soft material such as polyester or cotton. With reference to FIG. 1 and FIG. 2, the elongate pillow body 30 has a length dimension L, as measured between its ends 40A, 40B, of between about 76 and 85 centimetres thereby providing the elongate pillow body 30 with sufficient length for the user to place the elongate pillow body 14 between the legs so as to support the knees, pelvis, and lower back.

Figure 8:
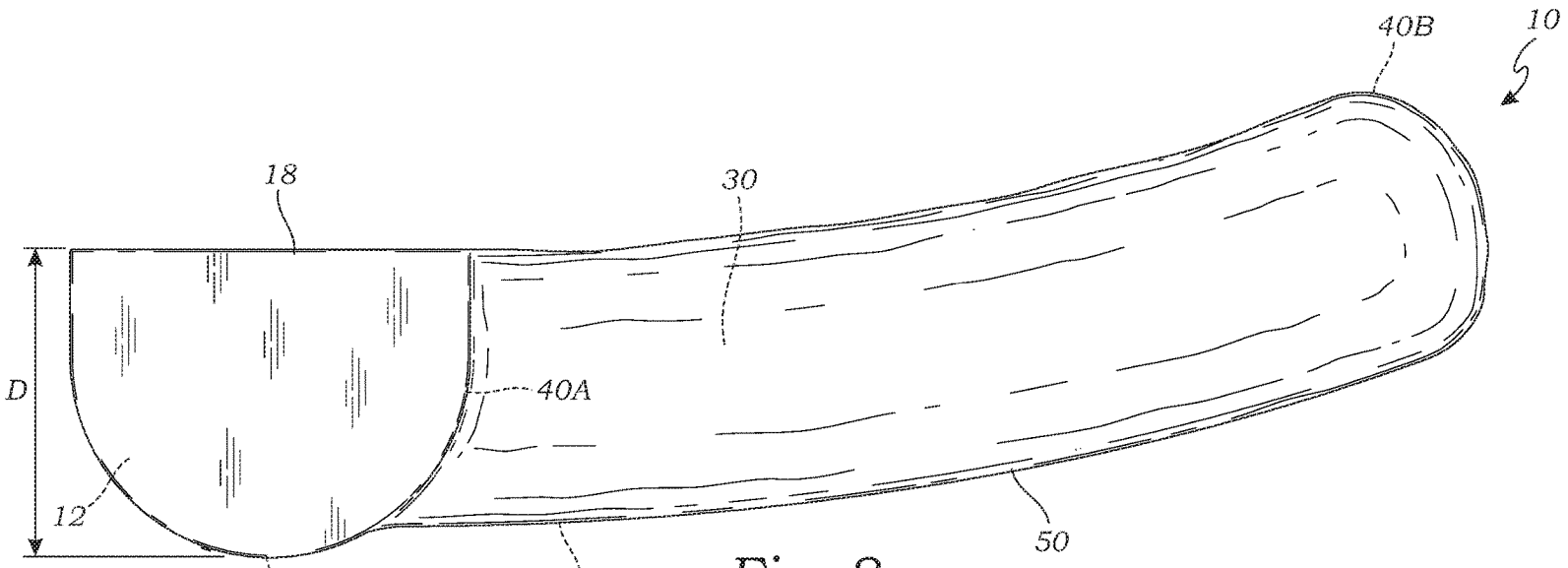
FIG. 8 is a bottom view of the support cushion of FIG. 1.
Figure 9:
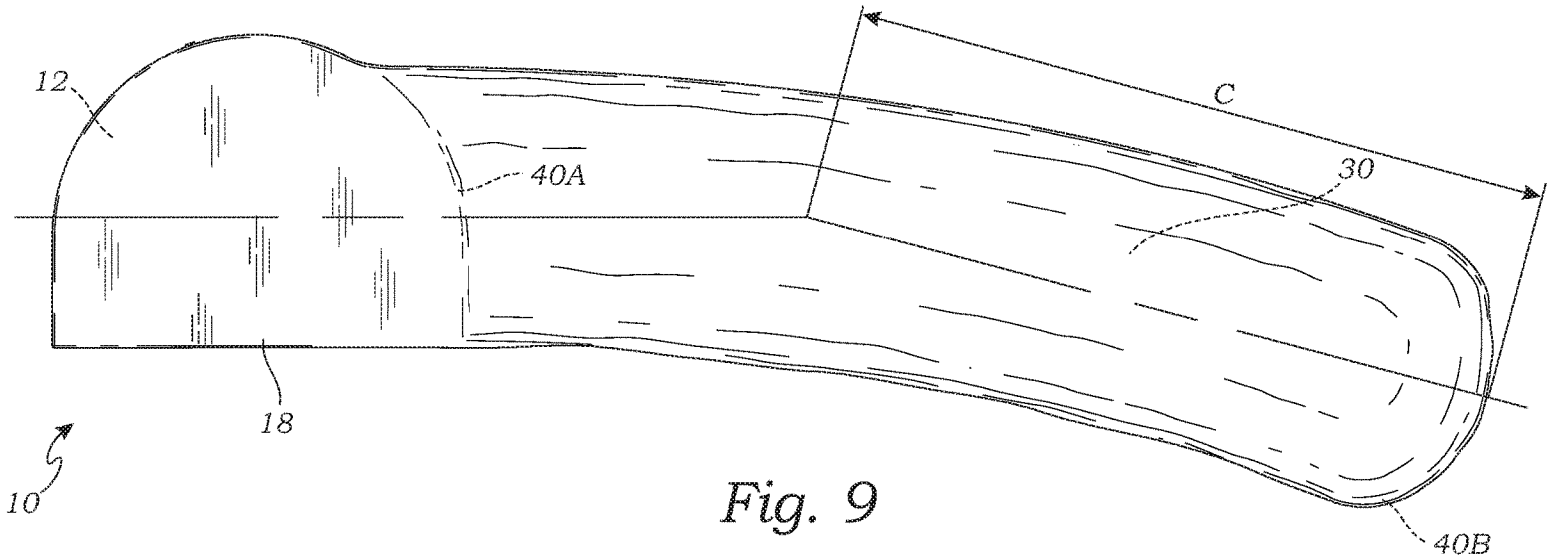
FIG. 9 is a top view of the support cushion of FIG. 1.

The elongate pillow body 30 has a maximum height H of about 20 centimetres, which height reduces towards the opposing end 40A thereof, to substantially meet a height H of the wedge-shaped body 12. With reference now also to FIG. 8 and FIG. 9, the elongate pillow body 30 is curved or angled forwardly as it extends laterally outwardly from the end 40A lying closest to the wedge-shaped body 12 towards its free end 40B, such that at least a portion of the free end 40B thereof lies forwardly of a plane on which the front surface 18 of the wedge-shaped body 12 lies.

In one embodiment, the angle or start of curvature of the elongate pillow body 30 is substantially defined within a portion C thereof lying between about 50 and 60 centimetres away from the free opposing end 40B thereof though the curve measurement may be greater or smaller in other embodiments. In this manner, the first third of the elongate pillow body 30 as measured from the wedge-shaped body 12 is substantially straight relative to the plane on which the front surface 18 of the wedge-shaped body 12 lies, with the remaining two thirds of the elongate pillow body 30 curved or angled forwardly thereof, such that the overall front and rear surfaces jointly and co-operatively formed by the wedge-shaped body 12 and elongate pillow body 30 are substantially concave and convex respectively.

To properly support the user's abdomen, the wedge-shaped body 12 is made from a material firmer than the material from which the elongate pillow body 30 is made. Preferably, the wedge-shaped body 12 is made from a foam-like material such as memory foam. The firmer material helps to keep the pelvis at a right angle to the horizon, thereby correcting lower back alignment.

With reference to FIG. 1, FIG. 2 and FIG. 8, the wedge-shaped body 12 has a width dimension W, as measured between its side ends 22A, 22B, of about 38 centimetres, and a depth dimension D, as measured between its front and rear surfaces 18, 20, of about 33 centimetres. Furthermore, with the height dimension h of the front surface 18 being about 1-4 centimetres (about 1 cm in this embodiment), and the height dimension H of the rear surface 20 being about 9-13 centimetres (about 11 cm in this embodiment), the upper surface 26 of wedge-shaped body 12 slopes operatively downwardly from the rear surface 20 towards the front surface 18.

To enable snug end-to-end orientation of the wedge-shaped body 12 with the elongate pillow body 30, the side end 22B of the wedge-shaped body 12 is contoured convexly with the opposing end 40A of the elongate pillow body 30 contoured concavely such that the wedge-shaped body 12 at least partially nests within the elongate pillow body 30.

Figure 4:
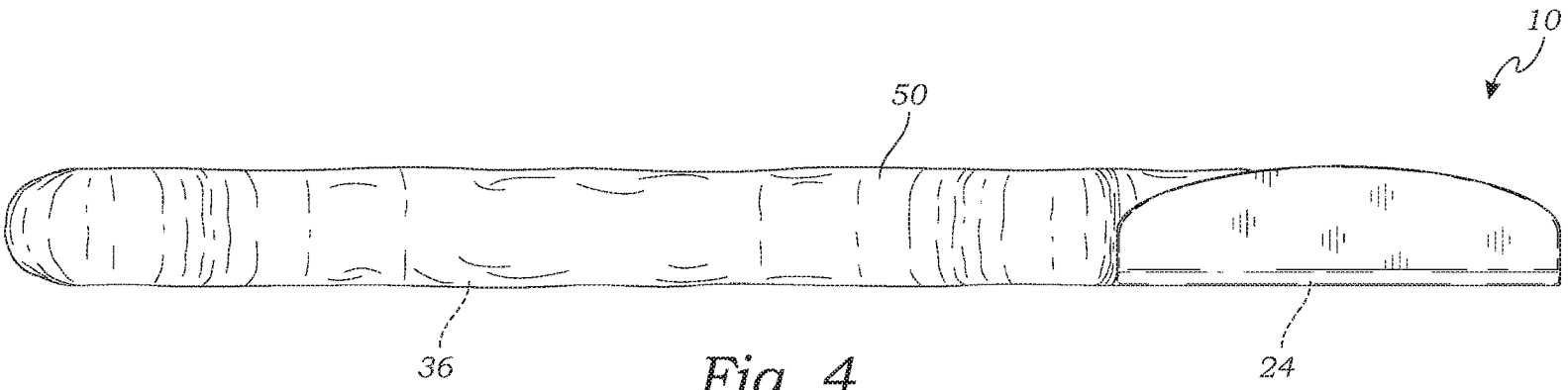
FIG. 4 is a front view of the support cushion of FIG. 1.
Figure 5:
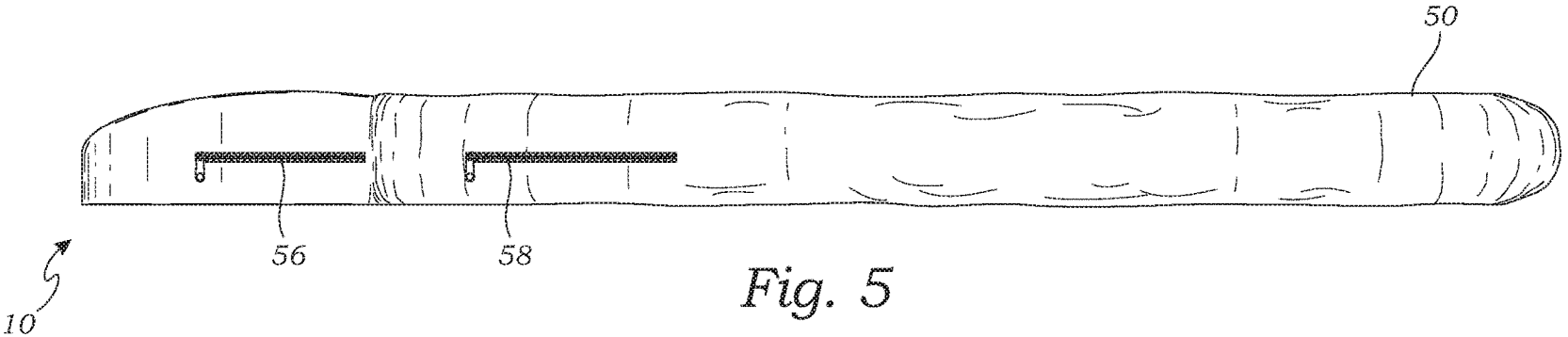
FIG. 5 is a rear view of the support cushion of FIG. 1.
Figure 7:
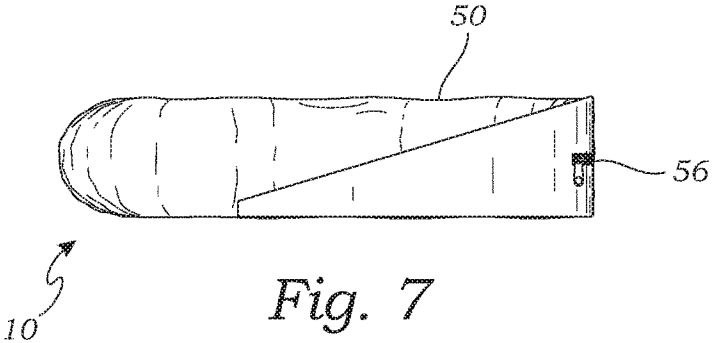
FIG. 7 is a right side view of the support cushion of FIG. 1.
Figure 6:
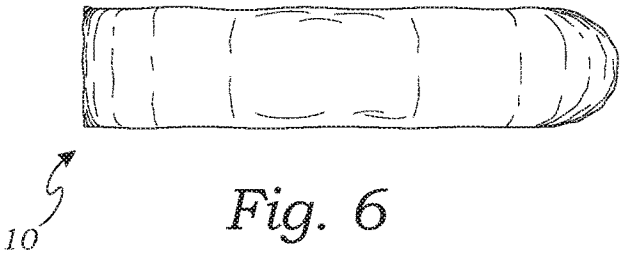
FIG. 6 is a left side view of the support cushion of FIG. 1.

With the wedge-shaped body 12 and the elongate pillow body 30 retained in this end-to-end orientation by the fabric cover 50, the respective lower surfaces 24, 36 thereof are substantially co-planar as illustrated in FIG. 4. Furthermore, and with the support cushion 10 in an unused neutral condition, the rear surface 20 of the wedge-shaped body 12 lies more rearward of the rear surface 34 of the elongate pillow body 30.

Through testing conducted, the inventor is of the view that a support cushion 10 comfortably, ergonomically and correctly supports the abdomen, knees, pelvis, and lower back of a user.

Preferably, the support cushion 10 includes a carry bag (not shown) into which the support cushion 10 is stowable in a compact, folded form. The carry bag may include a pair of carrying handles spaced from one another across an access opening thereinto, and straps securable across the access opening of the carry bag to secure contents operatively loaded into the carry bag there within. Alternatively, with the carry bag empty and rolled-up, the straps may be tied around the carry bag to retain it in a compact rolled-up condition. It will be appreciated that the carry bag can double-up as a shopping bag, and can be easily carried in a handbag in the compact rolled-up condition.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A support cushion for use by a pregnant woman, the support cushion comprising:

a wedge-shaped body for supporting the woman's abdomen while the woman is lying on her side, the wedge-shaped body having a front surface, a rear surface with a height dimension greater than a height dimension of the front surface, a pair of side ends, a lower surface and an upper surface tapering downwardly from the rear surface towards the front surface;

an elongate pillow body receivable between the woman's legs while she is lying on her side, the elongate pillow body having a front surface, a rear surface, a lower surface, an upper surface and a pair of opposing ends; and a fabric covering defining first and second compartments:

(i) respectively shaped and sized for receiving the wedge-shape body and elongate pillow body therein; and (ii) configured relative to one another thereby to orientate one end of the elongate pillow body end-to-end with one of the side ends of the wedge-shaped body such that the elongate pillow body extends laterally outwardly from the wedge-shaped body, wherein each of the compartments includes a closure for opening and closing access openings through which the respective wedge-shaped body and elongate pillow body are loadable and unloadable from the fabric covering;

wherein:

(i) the lower surface of the wedge-shaped body and the lower surface of the elongate pillow body are substantially co-planar; and (ii) that the rear surface of the wedge-shaped body forms a rearmost surface of the wedge-shaped body and the elongate pillow body;

and wherein the wedge-shaped body is made from a material being firmer than the material from which elongate pillow body is made.

2. The support cushion of claim 1, wherein the wedge-shaped body is made from a foam material.

3. The support cushion of claim 2, wherein the foam material of the wedge-shaped body is memory foam.

4. The support cushion of claim 3, wherein the wedge-shaped body has a width dimension as measured between the side ends thereof of 38 centimetres and a depth dimension as measured between the front and the rear surfaces thereof of 33 centimetres, and further wherein the height dimensions of the front surface and the rear surface are respectively 1 centimetres and 11 centimetres.

5. The support cushion of claim 1, wherein the elongate pillow body is angled or curved forwardly as it extends laterally outwardly from the wedge-shaped body towards its free end.

6. The support cushion of claim 5, wherein the elongate pillow body is made from a polyester or cotton material housed in a cover.

7. The support cushion of claim 6, wherein the elongate pillow body has a maximum height dimension of 20 centimetres, and a length dimension as measured between the opposing ends thereof of between 76 and 85 centimetres.

8. The support cushion of claim 7, wherein the angle or start of curvature of the elongate pillow body is substantially defined within a portion of the elongate pillow lying between 50 and 60 centimetres away from the free opposing end thereof, though the curve may measure as greater or smaller in other embodiments.

9. The support cushion of claim 1, wherein one end of the wedge-shaped body and one end of the elongate pillow body each have a corresponding contour for the one body to at least partially nest into the other body.

10. The support cushion of claim 1, wherein the rear surfaces of the wedge-shaped and elongate pillow bodies co-operatively form a convex surface, with the front surfaces of the wedge-shaped and elongate pillow bodies co-operatively forming a concave surface.

11. The support cushion of claim 1, including a carry bag for carrying the support cushion in a folded condition wherein the wedge-shaped body and the elongate pillow body are folded over one another one or more times.

12. The support cushion of claim 1, wherein the closures are zippers, and wherein the zippers are first and second zippers:

(i) the first zipper being located on the fabric covering such that with the wedge-shaped body received within the first compartment of the fabric covering, the first zipper lies substantially against the rear surface of the wedge-shaped body; and (ii) the second zipper being located on the fabric covering spaced from the first zipper such that with the elongate pillow body received within the second compartment of the fabric covering, the second zipper lies substantially against the rear surface of the elongate pillow body.

* * * * *